US008104534B2

(12) United States Patent
Olson et al.

(10) Patent No.: US 8,104,534 B2
(45) Date of Patent: Jan. 31, 2012

(54) MECHANICAL SEAL AND LOCK FOR TUBING CONVEYED PUMP SYSTEM

(75) Inventors: David L. Olson, Los Alamitos, CA (US); Josh T. Prather, Acton, CA (US)

(73) Assignee: Baker Hughes Incorporated, Houston, TX (US)

( * ) Notice: Subject to any disclaimer, the term of this patent is extended or adjusted under 35 U.S.C. 154(b) by 594 days.

(21) Appl. No.: 12/271,624

(22) Filed: Nov. 14, 2008

(65) Prior Publication Data

US 2009/0139730 A1 Jun. 4, 2009

Related U.S. Application Data

(60) Provisional application No. 60/987,999, filed on Nov. 14, 2007.

(51) Int. Cl.
*E21B 43/00* (2006.01)
*F04B 23/00* (2006.01)

(52) U.S. Cl. ..... 166/105; 166/242.6; 166/381; 417/360; 417/423.3

(58) Field of Classification Search ..... 166/377, 166/378, 381, 105, 242.6; 417/360, 423.3, 417/424.2

See application file for complete search history.

(56) References Cited

U.S. PATENT DOCUMENTS

| | | | | |
|---|---|---|---|---|
| 5,193,985 | A * | 3/1993 | Escue et al. | 417/53 |
| 5,725,053 | A * | 3/1998 | Weber | 166/105 |
| 5,988,992 | A | 11/1999 | Tetzlaff et al. | |
| 6,089,832 | A * | 7/2000 | Patterson | 417/360 |
| 6,193,474 | B1 | 2/2001 | Tetzlaff | |
| 6,705,402 | B2 | 3/2004 | Proctor | |
| 6,729,391 | B2 | 5/2004 | Hill et al. | |
| 6,868,912 | B2 | 3/2005 | Proctor | |
| 7,431,095 | B2 | 10/2008 | Olson et al. | |
| 2009/0145612 | A1 * | 6/2009 | Olson et al. | 166/369 |
| 2009/0242195 | A1 * | 10/2009 | Wicentovich | 166/244.1 |
| 2011/0127030 | A1 * | 6/2011 | Clark et al. | 166/212 |

* cited by examiner

*Primary Examiner* — Daniel P Stephenson
(74) *Attorney, Agent, or Firm* — Bracewell & Giuliani LLP

(57) ABSTRACT

A through tubing conveyed electrical submersible pumping system for use in a wellbore. The system includes a tubing string with an attached deployed drive system having a pump motor and a pump engaging receptacle, a pumping assembly insertable into the tubing deployed system, and sealing elements on both the tubing string and pumping assembly. Engaging the sealing elements while inserting the pumping assembly forms a seal. The system further includes mating latch members on the pumping assembly and the tubing string, the latch members selectively activated by engaging one another. The latch may include locking fingers disposed on the pumping system and a shoulder protruding into the tubing string; wherein inserting the pumping system into the tubing deployed system locking fingers with the shoulder for securing the pumping system to the tubing string.

18 Claims, 8 Drawing Sheets

MECHANICAL SEAL AND LOCK FOR TUBING CONVEYED PUMP SYSTEM

RELATED APPLICATIONS

This application claims priority to and the benefit ofU.S. Provisional Application Ser. No. 60/987,999, filed Nov. 14, 2007, the full disclosure of which is hereby incorporated by reference herein.

BACKGROUND

1. Field of Invention

The present disclosure relates to a through tubing submersible pump having a mechanically locking seal for sealing flow between the pump and the tubing.

2. Description of Prior Art

Submersible pumping systems are often used in hydrocarbon producing wells for pumping fluids from within the well bore to the surface. These fluids are generally liquids and include produced liquid hydrocarbon as well as water. One type of system used in this application employs an electrical submersible pump (ESP). ESPs are typically disposed at the end of a length of production tubing and have an electrically powered motor. Often, electrical power may be supplied to the pump motor via cable strapped to the exterior of the production tubing. ESP's may comprise centrifugal pumps or progressing cavity pumps. Progressing cavity pumps (PCP) are positive displacement pumps that consist of a helical steel rotor inside a synthetic elastomer bonded to a steel tube (stator). As the rotor turns within the stator, fluid moves through the pump from cavity to cavity. The resulting pumping action increases the pressure of the fluid, allowing production to the surface.

FIG. 1*a* depicts a partial sectional view of a prior art submersible ESP system disposed in a wellbore. The ESP production system 2 shown comprises a pumping system 12 on production tubing 8; where the tubing 8 is suspended within a cased wellbore 4. The downhole pumping system 12 comprises a pump section 13, a seal section 14, and a motor 17. The seal section 14 equalizes fluid pressure in the motor 17 with pressure in the wellbore fluid. An electrical conduit 15 is strapped externally to the tubing 8, pump section 13, and seal section 14. Energizing the motor 17 drives a shaft (not shown) coupled between the motor 17 and the pump section 13.

Inlets 16 provided at the bottom of the pump section housing provide a passage for formation fluid to flow from the annulus between the casing 5 and system 12 into the pump section 13. Perforations 7 project into an adjacent formation 6 to provide a source for the formation fluid. As illustrated by the arrows, the formation fluid flows from the formation 6, through the perforations 7, up the annulus, and to the inlets 16. Fluid drawn into the inlets 16 is pressurized within the pump section 13, and then discharged into the tubing 8.

When installing an ESP through tubing, the pump assembly is lowered into and suspended within the production tubing. Typically the motor is mounted to the lower end of the production tubing, and the pump assembly stabs into engagement with the drive shaft of the motor. In this configuration the pump discharges into the production tubing. FIG. 1*b* provides in partial sectional view an example of a prior art through tubing conveyed ESP initially deployed in a wellbore and before installing the pump. In FIG. 1*b*, a tubing deployed drive system 19 is shown on production tubing 8 disposed in a cased wellbore 4. The tubing deployed drive system 19 illustrated comprises an engaging receptacle 20, a seal section 14, and a motor 17.

FIG. 1*c* depicts a partial sectional view of an example of a through tubing conveyed ESP system having a pump installed. In FIG. 1*c*, an ESP production system 2 is formed when a downhole pumping assembly 21 is inserted within a tubing deployed drive system 19, a packer 22 is installed within the tubing 8 at the top of the pump, and a tubing anchor 23 is installed within the tubing 8 at the top of the packer. The downhole pumping assembly 21 comprises an engaging base (not detailed) compatible with the engaging receptacle 20, an inlet section (not detailed), a pump section, and a receptacle (not detailed) suitable for use with downhole tooling commonly found in oilfield practice. A stinger on the packer 22 sealingly inserts into the tooling receptacle at the top of the pump assembly 21, and a stinger on the tubing anchor 23 sealingly inserts into a like receptacle at the top of the packer. The packer 22 serves to isolate the produced fluids from the well bore, and the tubing anchor 23 serves to secure the pumping assembly 21 within the tubing 8.

Energizing the motor 17 then drives shafts (not shown) variously coupled between the motor and the pump assembly 21. Inlets 16 are provided on the engaging receptacle 20 wherein formation fluid can be drawn into the inlets 16 then into the inlet section of the pump assembly 21 and up into the pump section. Formation fluid flow, represented by arrows, flows into the annulus from perforations 7 extending a surrounding hydrocarbon producing formation 6. The pump discharges the formation fluid through the packer 22 and the tubing anchor 23 into the tubing 8. Packer 22 provides sealing between the pump discharge and the inlets 16, thereby maintaining sufficient pressure in the tubing 8 to force the production fluid up the well bore 4 to the wellhead 9. Upon reaching the wellhead 9, the production fluid can be distributed via an attached production line 10.

SUMMARY OF INVENTION

The present disclosure includes a through tubing conveyed electrical submersible pumping system for use in a wellbore comprising, a tubing string, a seal ring protruding inward from the tubing string inner wall, a tubing deployed drive system having a pump motor, a pumping assembly insertable into the tubing deployed system, a seating cone on the pumping assembly that when engaged with the seal ring forms a seal in the space between the tubing string and the pumping assembly. Engaging the seal ring with the seating cone is accomplished by inserting the pumping assembly into the tubing string to contact the ring and cone.

An optional latch assembly is provided having corresponding latching components on the pumping assembly and the tubing string. The pumping assembly is selectively latchable within the tubing string by advancing the pumping assembly until the latching components engage. In one embodiment the latching components include locking fingers disposed on the pumping system and a shoulder within the tubing string. Latching may include sliding the fingers past the shoulder, wherein the fingers bend inwards when contacting the shoulder and spring outward when pushed past the shoulder. The fingers abut the shoulder lower surface to provide a retaining force for securing the pumping system within the tubing string. Optionally, the seal ring may comprise the shoulder.

BRIEF DESCRIPTION OF DRAWINGS

Some of the features and benefits of the present invention having been stated, others will become apparent as the description proceeds when taken in conjunction with the accompanying drawings, in which.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Figure 1A:
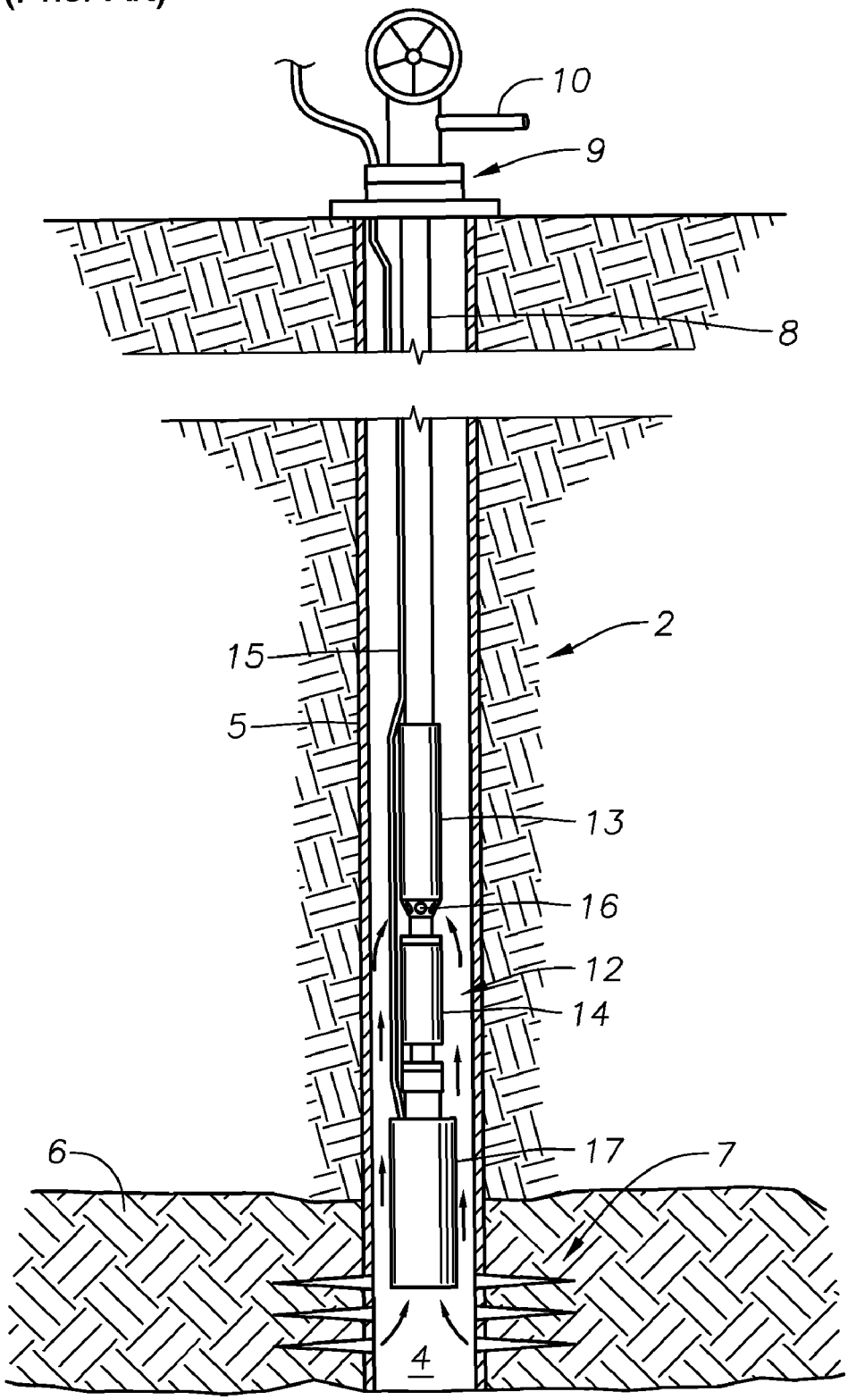
Fig. 1a (Prior Art)
FIG. 1*a* is a partial cross sectional view of a prior art electric submersible pump.
Figure 1B:
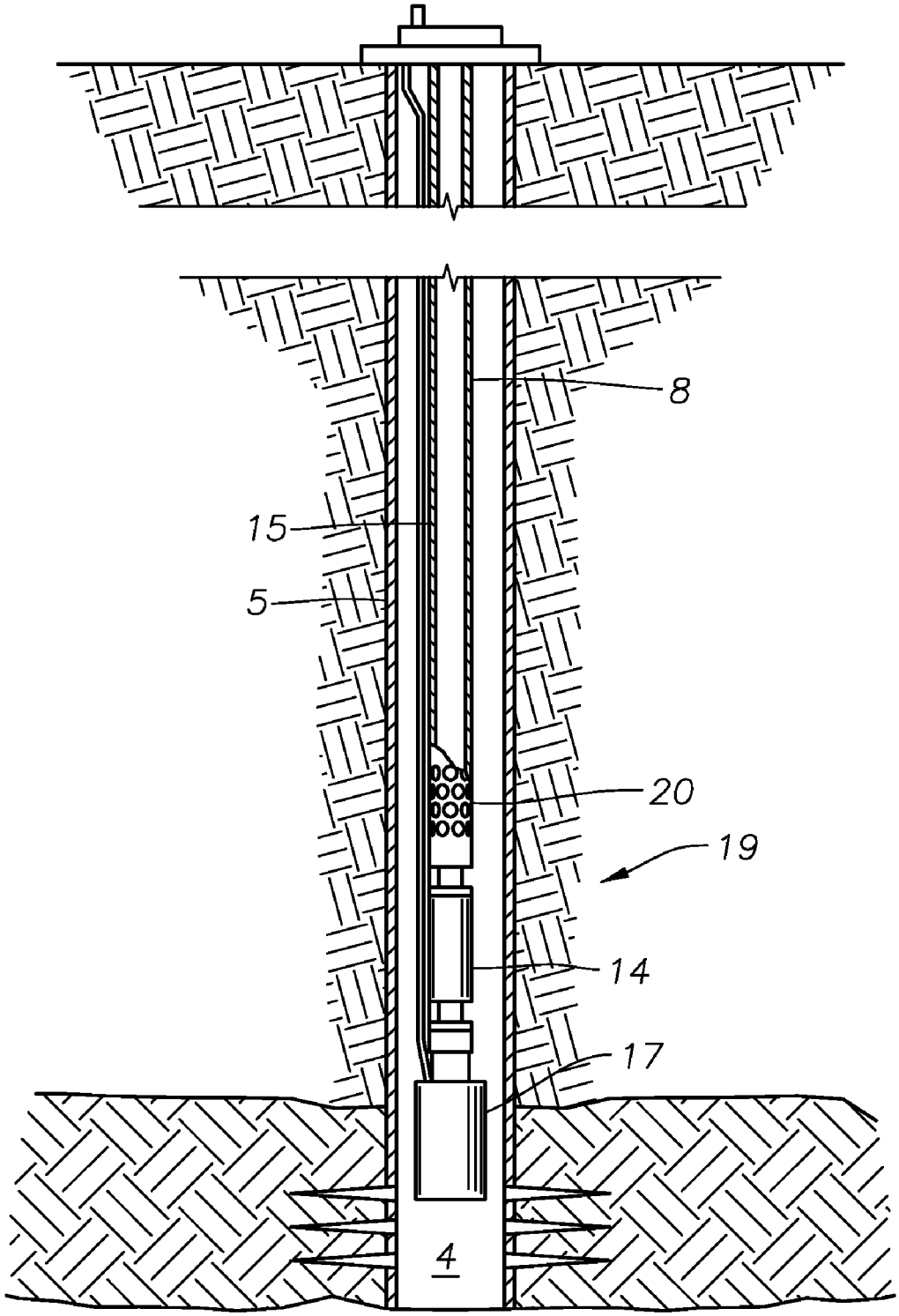
Fig. 1b (Prior Art)
FIG. 1*b* is a partial cross sectional view of a prior art tubing deployed drive system installation of a through tubing conveyed submersible pumping system.
Figure 1C:
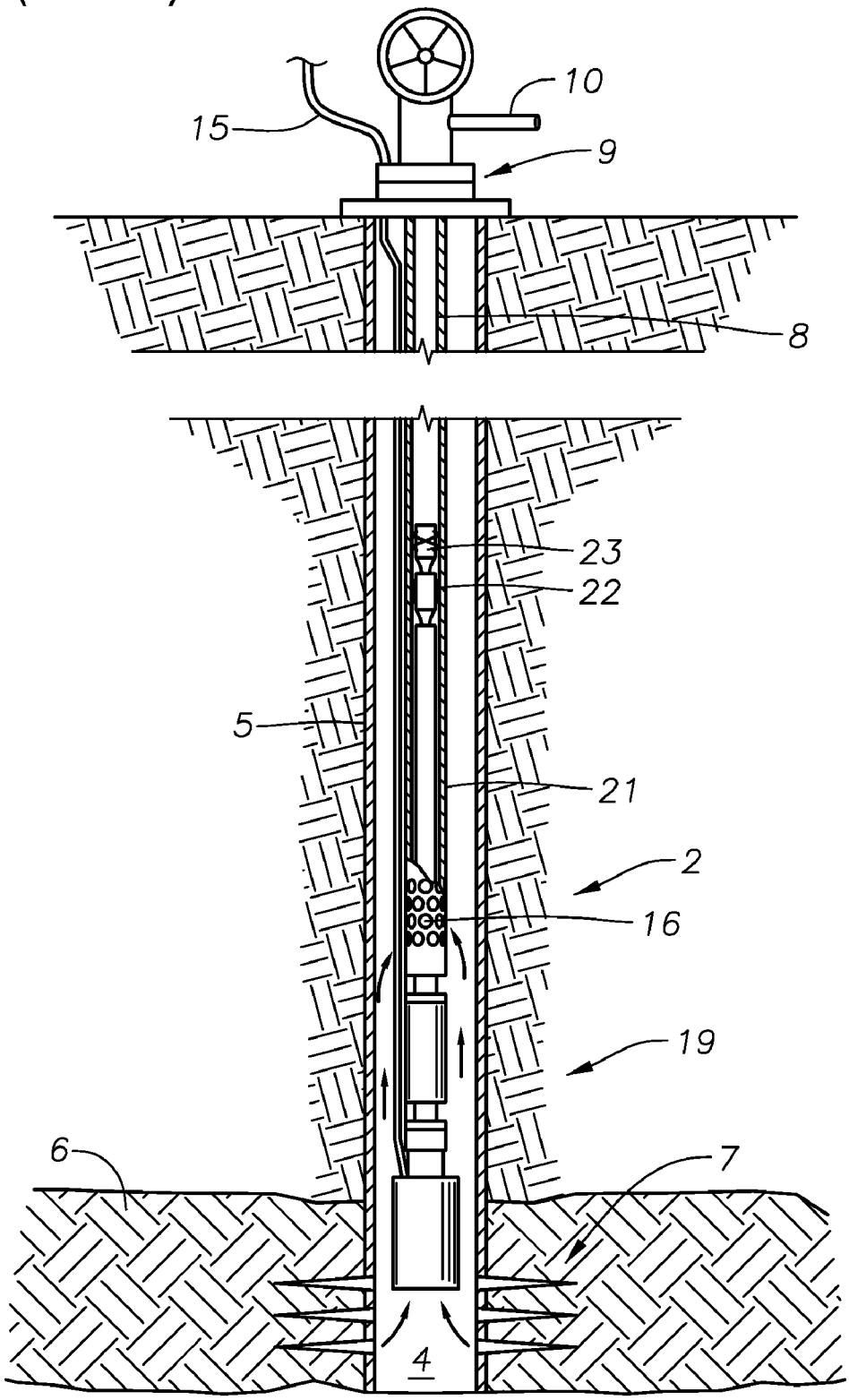
Fig. 1c (Prior Art)
FIG. 1*c* is a partial cross sectional view of a prior art completed installation through tubing conveyed submersible pump.
Figure 2:
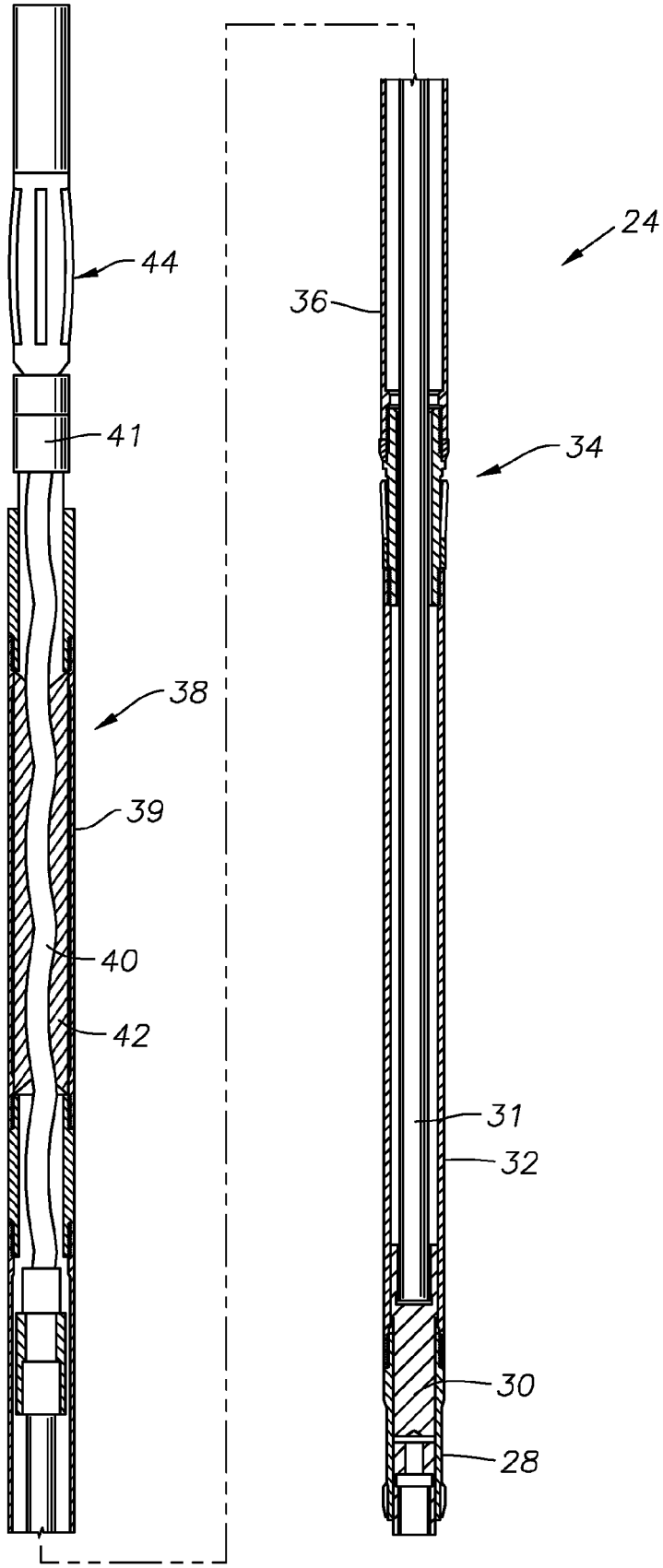
FIG. 2 illustrates in a side sectional view an embodiment of a pumping system.

FIG. 2 illustrates an embodiment of a progressing cavity pumping system 24 in a side partial sectional view. The pumping system 24 comprises an engaging base 30 on its lower end externally configured to mate within production tubing 76 (FIG. 4). The engaging base 30 includes a coupling 28 on its lower end configured to mate with an intake coupling (not shown) disposed on the tubing 76. A lower flex shaft housing 32 connects to the engaging base 30 on an end opposite the coupling 28. As shown, the lower flex shaft housing 32 is a generally tubular member having apertures on its outer surface configured to receive wellbore production fluid for delivery to the pump section 38. A mandrel assembly 34 coaxially connects the lower flex shaft housing 32 to the upper flex shaft housing 36. A flex shaft 31 is shown provided within the pumping system 24 extending from the lower to the upper flex shaft housing 32, 36.

The pump section 38 of FIG. 2 comprises a progressing cavity pump having a rotor 40 and a stator 42. The rotor 40 outer dimensions correspond in shape and profile to the stator 42. The rotor 40, which preferably comprises metal, has an exterior helical configuration and splined lower end. The rotor 40 is configured to rotate within the stator 42, wherein the stator 42 is preferably formed from an elastomeric material. The stator 42 is shown having double helical cavities located along its axis through which the rotor 40 rotates. Rotation of the rotor 40 therefore progressively urges production fluid axially up within the housing 39 and on to the pump discharge. The rotor 40 connects to the flex shaft 31 on one end so that rotating the flex shaft 31 drives the rotor 40. As discussed in more detail below, the flex shaft 31 is driven by a pump motor. A centralizer 44 is shown provided in the pumping system 24 proximate to its upper end. The centralizer 44 includes a plurality of outwardly extending bowed elements for coaxially aligning the pumping system 24 within the tubing. The method and apparatus disclosed herein may include a centrifugal pump in place of or addition to a progressing cavity pump.

Figure 3A:
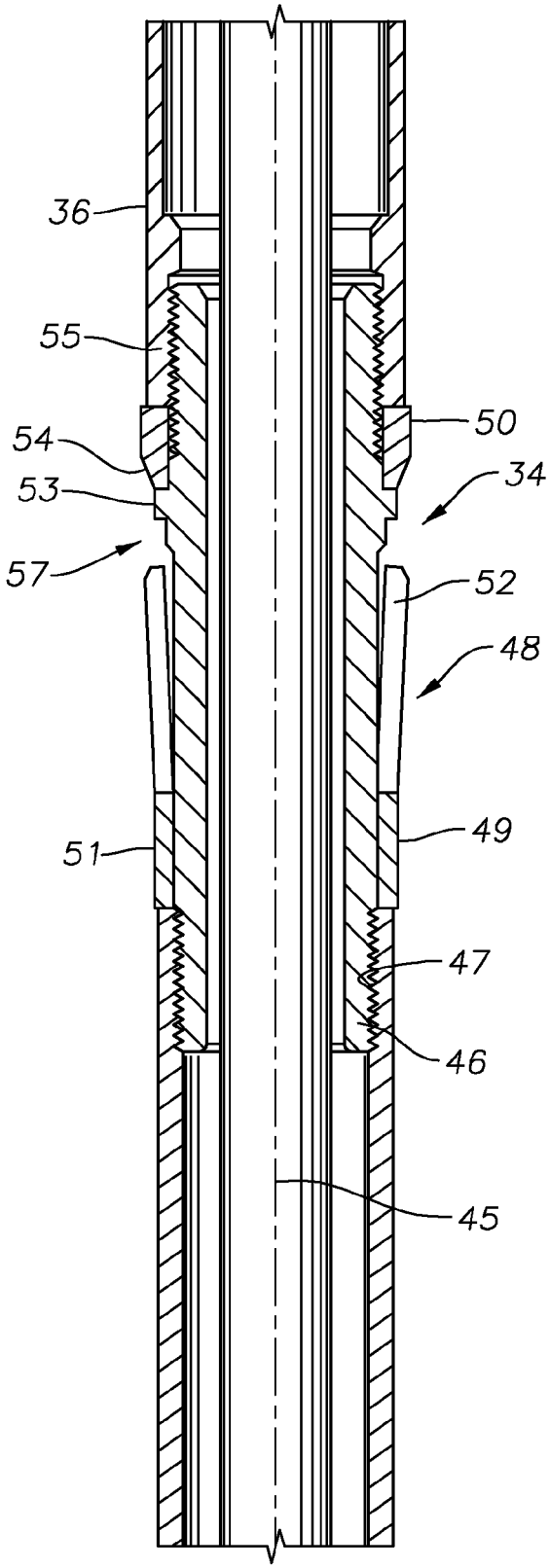
FIGS. 3*a* and 3*b* provide side partial sectional views of adjacent sections of a portion of the pumping system of FIG. 2.
Figure 3B:
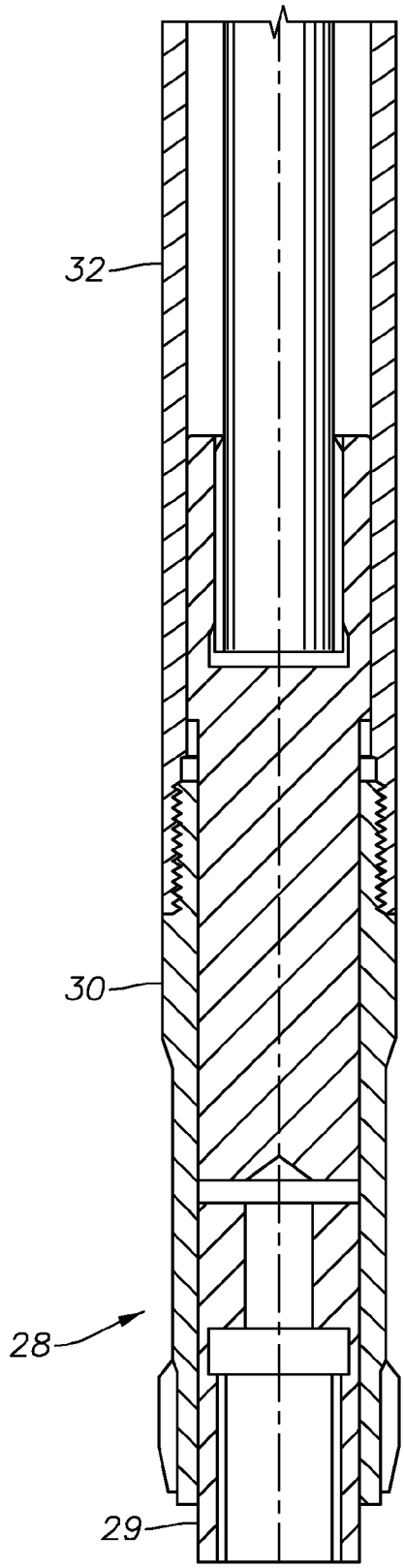

FIGS. 3*a* and 3*b* are side cross sectional views of a lower portion of the insertable pumping system 24 of FIG. 2. Shown in FIG. 3*a*, the mandrel assembly 34 comprises a locking mandrel 46, locking fingers 48, and a seating cone 50. The locking mandrel 46 is a generally annular structure having external threads on both of its ends. Engaging threads on a mandrel 46 end with threads on the lower flex shaft housing 32 shown in FIG. 3*b*. A threaded connection 47 couples the mandrel 46 and lower flex shaft housing 32. Engaging threads on the mandrel 46 end opposite the threaded connection 47 with threads on the upper flex shaft housing 36 forms a threaded connection 55 coupling the mandrel 46 to the upper flex shaft housing 36.

An annular base 51 circumscribes a portion of the mandrel 46. Corresponding threads on the mandrel 46 outer surface and base 51 inside are engaged to form a threaded connection 49 that couples the base 51 to the mandrel 46. The locking fingers 48 extend from the annular base 51 toward the upper flex shaft housing 36 shown aligned generally parallel with the housing axis 45. The fingers 48 terminate to form a free end 52 on the end of the locking fingers 48 opposite the base. The locking mandrel 46 outer diameter transitions outward to form a profile 53, where the profile 53 outer diameter is greater than the outer diameter of mandrel 46 portion circumscribed by the fingers 48. The space between the profile 53 and free ends 52 defines a void 57 circumscribing the mandrel 46.

The seating cone 50 is annularly disposed around the mandrel 46 and adjacent the upper portion of the profile 53. The seating cone 50 has a generally ring like structure, wherein its outer diameter is illustrated as increasing with distance away from the profile 53 then remaining constant. The seating cone 50 end opposite the profile 53 is adjacent the upper flex shaft housing 36. The profiled section of the seating cone 50 forms a leading edge 54 disposed at an angle to the axis 45 of the pumping system.

Figure 4A:
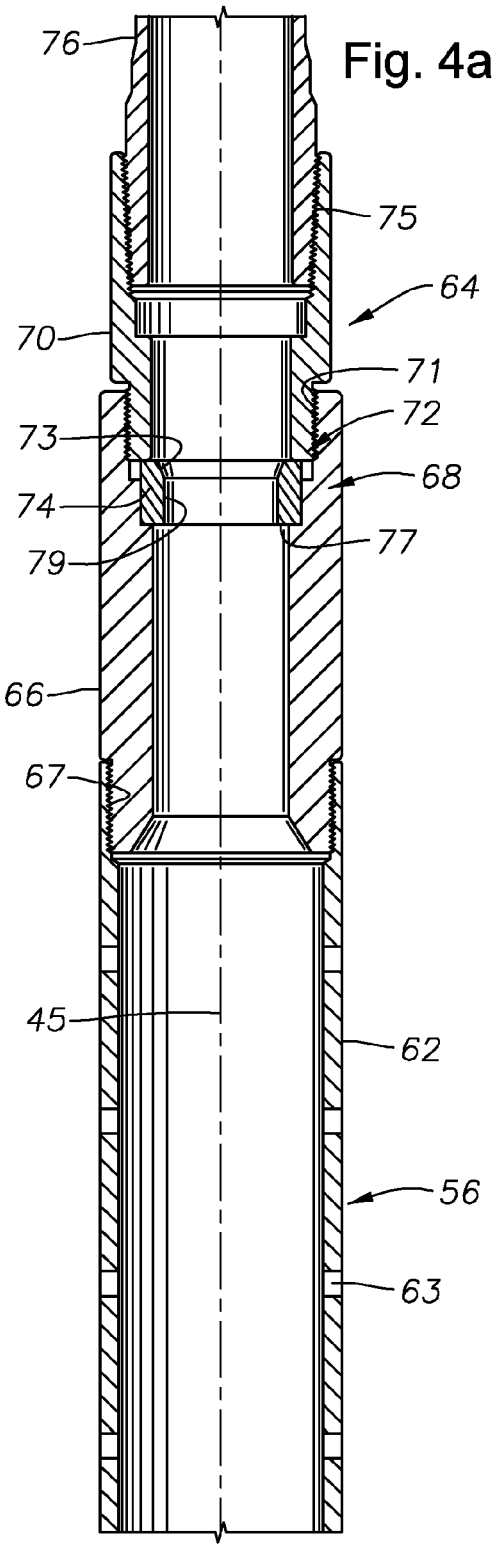
FIGS. 4*a* and 4*b* depict adjacent sections of a tubing installation with a seal assembly in a side partial sectional view.
Figure 4B:
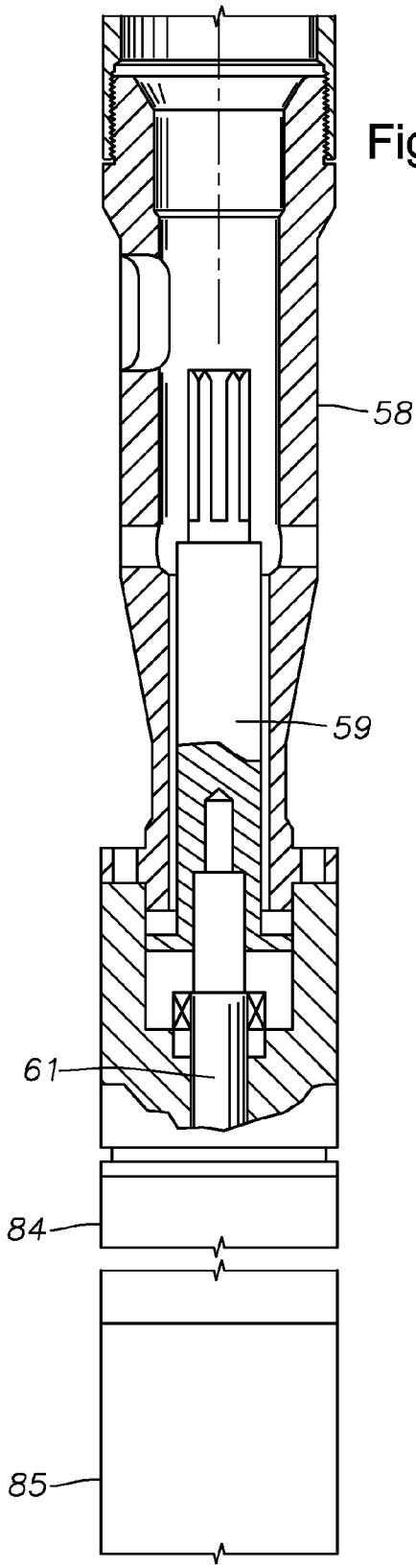

Provided in a side cross sectional view of FIG. 4 is an illustration of a tubing crossover 56 shown formed on a lower end of production tubing 76. The tubing crossover 56 includes a sealing assembly 64, an intake nipple 62, an engaging receptacle 58, and an intake coupling 59. The intake coupling 59 is disposed within the engaging receptacle 58 and shown coupled to a motor driven shaft 61 and configured to receive the coupling 28 (FIG. 3*b*). A pump motor 85 is shown coupled to the crossover 56 to provide rotational energy for driving the pumping system 24. A seal 84 is also provided for equalizing pump motor 85 internal pressure with ambient pressure. Thus for connecting to a pump motor, the lower end of the engaging receptacle 58 is flanged for connection to the seal 84 and pump motor 85. An optional gear reducer (not shown) may be included between the seal 84 and the pump motor 85. The intake nipple 62 is threadingly connected on one end to the engaging receptacle 58 (FIG. 4*b*) and on its opposite end to the seal assembly 64. Apertures 63 are provided on the intake nipple 62 for enabling passage of wellbore fluid into the tubing crossover 56.

In the embodiment of FIG. 4*a*, the seal assembly 64 is shown integral within the tubing string 76 and connected to the string 76 lower end and the tubing crossover 56 upper end. In the embodiment shown the seal assembly has a lower seating nipple 66 (or mandrel), an upper seating nipple 70 (or mandrel), and a seating ring 74. The lower seating nipple 66 has a generally annular configuration and is threaded on the outer circumference of its lower end. Corresponding threads are formed on the inner diameter of the upper end of the intake nipple 62. Mating the threads of the intake nipple 62 with those of the lower seating nipple 66 forms a threaded connection 67 thereby connecting these two members. Optionally, as illustrated, the lower seating nipple 66 wall thickness is greater than the intake nipple 62 wall thickness. The thickness difference forms a reduced inner diameter in the region along the axis 45 surrounded by the seal assembly 64.

The upper seating nipple 70 includes two sections, where one of the sections has a smaller outer diameter and is threaded on its outer surface. The lower seating nipple 66 has an end with threads on its inner surface engaging the threaded surface on the upper seating nipple 70 to form a threaded connection 71. A profile 68 is provided on the lower seating nipple 66 inner circumference spaced inward from the threaded connection 71. A seating ring 74 is shown disposed between the profile 68 and an abutment 72 along end of the upper seating nipple 70 end. The combination of the abutment 72 and the profile 68 creates a generally rectangular space in which the seating ring 74 is disposed. Tightly coupling the lower seating nipple 66 to the upper seating nipple 70, the threaded connection 71 secures the seating ring 74 between these two members.

As shown, the seating ring 74 inner diameter is less than the lower and upper nipple 66, 70 inner diameters. The seating ring 74 smaller inner diameter forms a protrusion extending inside the tubing string 76 having coplanar upper and lower sides 73, 77 extending inward respectively from the upper seating nipple 70 and the lower seating nipple 66. The upper and lower sides 73, 77 are connected by an inner surface 79 to form an abutment shoulder protruding within the tubing string 76. Optionally, the seating ring inner surface 79 is profiled adjacent the upper side 73 to conform to the seating cone leading edge 54. FIG. 4*b* further illustrates an intake coupling 59 within the engaging receptacle 58; the intake coupling 59 is driven by the motor 85 through its coupling with motor driven shaft 61. A seal section 84 is schematically depicted disposed between the motor 85 and the engaging receptacle 58.

Figure 5A:
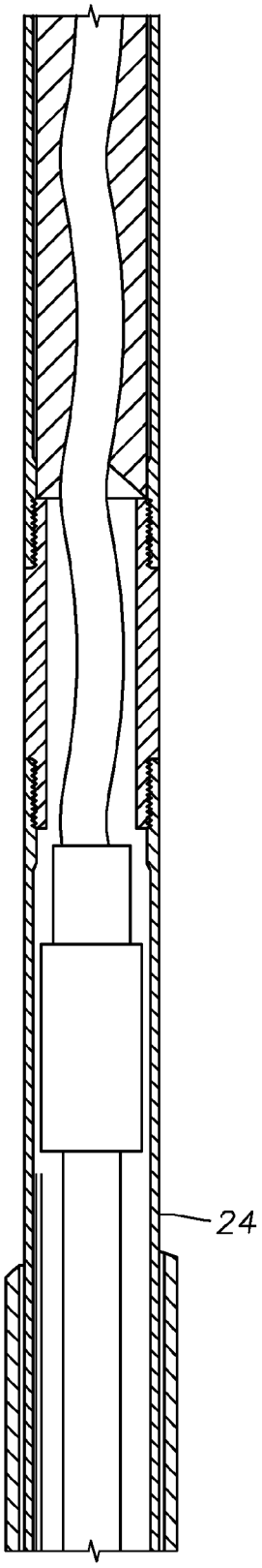
FIGS. 5*a*-5*c* provide side views of adjacent portions of a completed assembly.
Figure 5B:
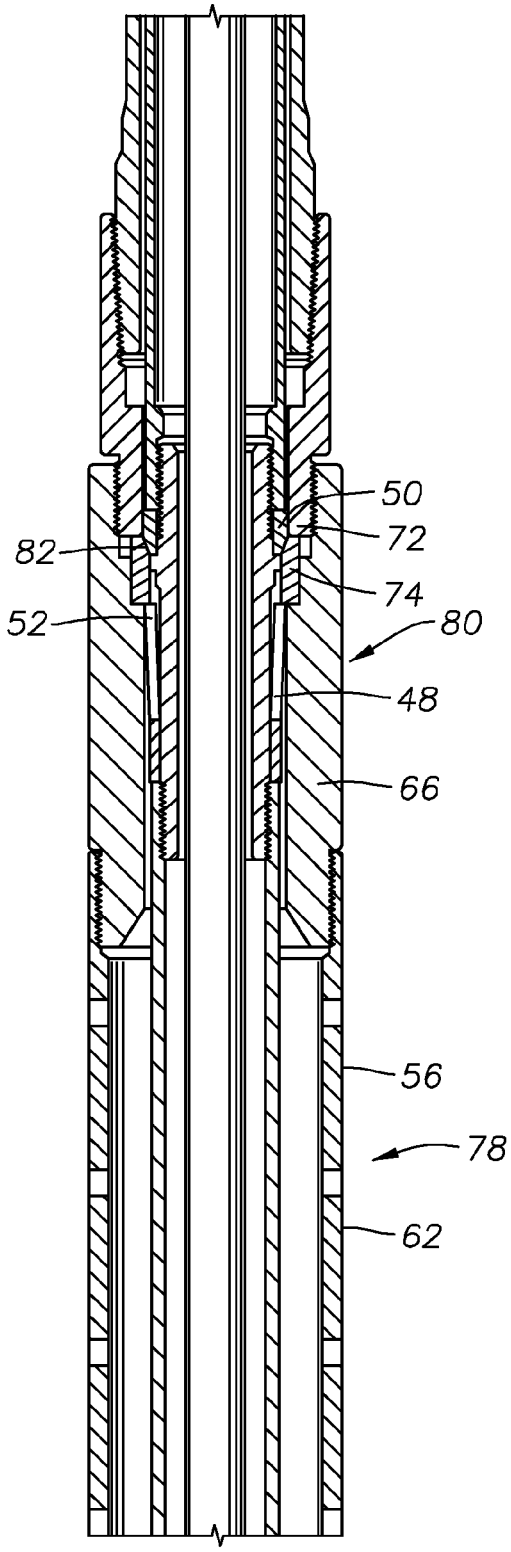
Figure 5C:
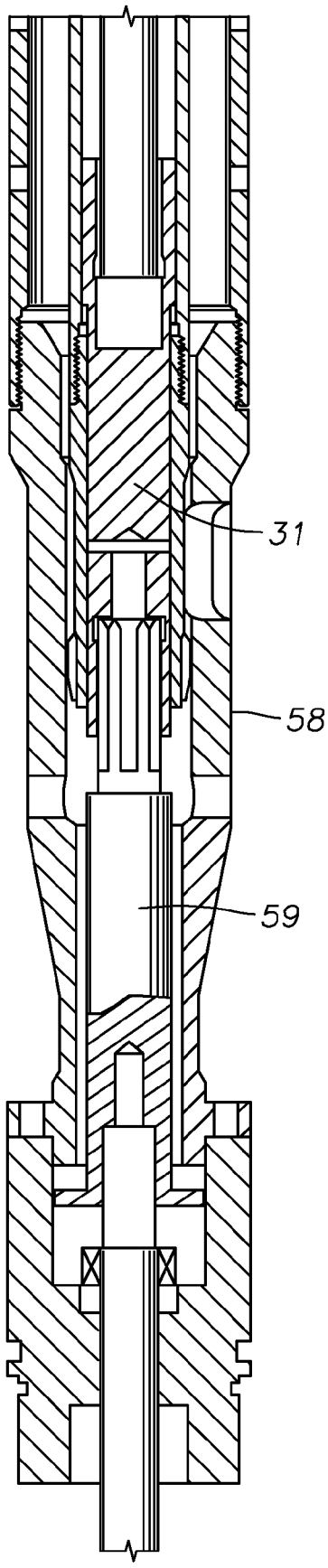

FIGS. 5*a*-5*c* show in a side sectional view an embodiment of a completed assembly 78 of a pumping system 24 disposed within a tubing crossover 56. Forming the completed assembly 78 requires applying a latching force to squeeze the locking fingers 48 axially through the smaller diameter of the seating ring 74. Those skilled in the art can determine and apply a latching force without undue experimentation. As the locking fingers 48 engage the seating ring 74 they are pushed radially inward toward the axis 45 and snap radially outward when urged past the seating ring 74. A spring force inherent in the locking fingers 48 pushes the fingers 48 outward so they abut the seating ring 74 lower edge and create contacting engagement for latching the pumping system 24 to the tubing string 76.

With reference now to FIG. 5*b*, the pumping system 24 and tubing crossover 56 components are dimensioned to ensure the free ends 52 provide an axial force on the seating ring 74 when installed. The axial force sealingly engages the seating ring 74 with the seating cone 50. Moreover, the seating cone 50 profiled edge 54 sealingly mates with the similarly profiled edge on the seating ring 74. Decoupling the pumping system 24 and the tubing string 76 is accomplished by applying a pulling force onto the pumping system 24 to uncouple the latch, determining and applying a decoupling force is also within the capabilities of those skilled in the art.

The sealing engagement between the seating cone 50 and the seating ring 74 isolates the intake 32 of the pumping system 24 from the pump discharge. An advantage of the system disclosed herein is a pressure seal can be formed substantially concurrent with pump insertion into a tubular member, such as the production tubing 76. An additional advantage of the system disclosed is the combination of the seating cone 50 and the seating ring 74 can receive at least a portion of axial forces produced during pumping, such as the pump shaft thrust. The downward coupling of the pumping system 24 with the tubing installation 56 provides additional mechanical connectivity of the flex shaft 31 and coupling 28 (FIG. 3*a*) with the intake coupling 59 establishing a power path from the motor 85 to the pump 38. In the embodiment of FIG. 5*c*, tabs on the pump section 38 lower end mates with profiles provided in the receptacle 58. The tabs cooperate with the profiles can prevent the pump section 38 from rotating during operation. Further, the downward installation secures the pumping system engaging base 30 (FIG. 3*a*) within the tubing crossover engaging receptacle 58 establishing mechanical connectivity between the external elements of the pumping system 24 and the tubing deployed system. This mechanical connectivity also links the pump stator 42 to the receptacle 58.

It is to be understood that the invention is not limited to the exact details of construction, operation, exact materials, or embodiments shown and described, as modifications and equivalents will be apparent to one skilled in the art. For example, embodiments exist where the downward facing shoulder engaged by the free ends of the fingers is a dedicated element apart from the seal ring. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

The invention claimed is:

1. A submersible pumping system for pumping fluid from a wellbore, the system comprising:

a tubing string selectively disposable in the wellbore;

a pump motor coupled with a lower end of the tubing string;

a seal ring protruding radially into the tubing string above the motor;

a pump having a housing, the pump insertable within the tubing string into engagement with the motor;

a profiled seating cone on the pump, so that when the pump is inserted into the tubing string, the seating cone sealingly engages the seal ring to form a seal in an annulus between the pump inlet and the pump discharge; and a cantilevered finger having free and an end strategically coupled to the pump, so that when the seating cone engages the seal ring, the free end contacts the seal ring on a side opposite the seating cone.

2. The submersible pumping system of claim 1, wherein the contact between the free end and the seal ring latches the pump to the tubing.

3. The submersible pumping system of claim 1, wherein the pump is selected from the list consisting of a centrifugal pump and a progressing cavity pump.

4. The submersible pumping system of claim 1, wherein the tubing string comprises, an annular lower nipple threadingly connected to an end of an upper nipple, the upper nipple threadingly connected to the production tubing on an end opposite the lower nipple, and opposing shoulders formed on the upper and lower nipple inner surfaces, wherein the seal ring is retained between the opposing shoulders thereby coupling the seal ring to the tubing string.

5. The submersible pumping system of claim 1, further comprising a flex shaft connecting the pump motor to the pump.

6. The submersible pumping system of claim 5, further comprising a coupling on the pump system lower end adapted for connection to a shaft driven by the pump motor, the flex shaft engaging the coupling.

7. The submersible pumping system of claim 1, further comprising a seal section disposed adjacent the pump motor.

8. A method of wellbore operations comprising:

affixing a pump motor to a lower end of a tubing string;

mounting a seal ring to the tubing, the seal ring protruding from the tubing inner surface toward the tubing axis:

installing the pump motor and tubing in a well;

inserting a pump into the tubing, the pump having a profiled seating cone;

engaging the profiled seating cone with the seal ring; and axially forcing the seating cone against the seal ring to form a seal between the pump and tubing inner circumference and to latch the pump to the tubing.

9. The method of claim 8, further comprising engaging the pump with the motor.

10. The method of claim 8, wherein the pumping system and the tubing string comprise corresponding engaging latch members selectively activated to latch together the pumping system and the tubing string.

11. The method of claim 10, further comprising inserting the pump within the tubing string to align the corresponding latch members, applying a latching force onto the pump for engaging the corresponding engaging latch members thereby latching together the pump and tubing string.

12. The method of claim 11, wherein the latch member on the pump slides past and engages a downward facing shoulder.

13. The method of claim 12, further comprising removing the pump from the wellbore by applying an unlatching force to the pump to disengage the latch members, and pulling the pump from within the tubing string.

14. A submersible pumping system for pumping fluid from a wellbore, the system comprising:

a tubing string adapted for deployment in the wellbore;

a pump motor coupled with an end of the tubing string to be deployed first in the wellbore;

a seal ring protruding radially into the tubing string, the seal ring above the motor;

a pump adapted to be inserted within the tubing string and into engagement with the motor;

a profiled seating cone on the pump adapted to abut against the seal ring to form a seal in an annulus between the pump inlet and the pump discharge; and a cantilevered finger mounted onto the pump and having a free end axially urging against the seal ring on a side opposite the seating cone.

15. The submersible pumping system of claim 14, wherein the free end is radially outward from an end of the cantilevered finger mounted to the pump, so that during pump insertion into the tubing string the finger contacts the seal ring and elastically bends toward the pump, and when moved past the seal ring the finger springs away from the pump into engagement with a downward facing shoulder on the seal ring, thereby latching the pump and the tubing and maintaining sealing contact between the seal ring and the seating cone.

16. The submersible pumping system of claim 14, wherein the pump is selected from the list consisting of a centrifugal pump and a progressing cavity pump.

17. The submersible pumping system of claim 14, further comprising an assembly integrally formed with the tubing string, wherein the seal ring is retained in the assembly.

18. The submersible pumping system of claim 14, further comprising a seal section disposed adjacent the pump motor.

* * * * *

UNITED STATES PATENT AND TRADEMARK OFFICE

CERTIFICATE OF CORRECTION

PATENT NO. : 8,104,534 B2
APPLICATION NO. : 12/271624
DATED : January 31, 2012
INVENTOR(S) : David L. Olson It is certified that error appears in the above-identified patent and that said Letters Patent is hereby corrected as shown below:

Column 6, line 17, delete “can” and insert --to--

Column 6, line 52, after “having” insert --a--; after “free” insert --end--

Signed and Sealed this
Nineteenth Day of June, 2012

David J. Kappos

David J. Kappos
*Director of the United States Patent and Trademark Office*